US007708250B1

(12) United States Patent
Dein

(10) Patent No.: US 7,708,250 B1
(45) Date of Patent: May 4, 2010

(54) CEILING PANEL SUPPORT APPARATUS

(76) Inventor: Alan J. Dein, 733 NW. Waterlily Pl., Jensen Beach, FL (US) 34957

( * ) Notice: Subject to any disclaimer, the term of this patent is extended or adjusted under 35 U.S.C. 154(b) by 66 days.

(21) Appl. No.: 12/033,709

(22) Filed: Feb. 19, 2008

(51) Int. Cl.
*A47F 5/00* (2006.01)

(52) U.S. Cl. ..... 248/354.1; 248/125.2; 414/11

(58) Field of Classification Search ..... 248/354.1, 248/125.2; 414/11; 182/141; 254/387; 211/197
See application file for complete search history.

(56) References Cited

U.S. PATENT DOCUMENTS

| | | | | |
|---|---|---|---|---|
| 2,899,084 | A | 8/1959 | Brunnemer et al. | |
| 2,939,590 | A * | 6/1960 | Henry | 414/11 |
| 2,983,474 | A * | 5/1961 | Hanna | 248/161 |
| 3,305,219 | A | 2/1967 | Rhodes | |
| 3,487,952 | A | 1/1970 | Owens et al. | |
| 3,822,023 | A | 7/1974 | Cordel | |
| 4,036,475 | A * | 7/1977 | Singleton | 254/133 R |
| 4,375,934 | A | 3/1983 | Elliott | |
| 4,600,348 | A * | 7/1986 | Pettit | 414/11 |
| D295,098 | S | 4/1988 | Delmerico | |
| 5,979,857 | A * | 11/1999 | Holm | 248/451 |
| 6,244,810 | B1 * | 6/2001 | Reyes | 414/11 |
| 6,269,753 | B1 * | 8/2001 | Roddan | 108/50.01 |
| 6,439,515 | B1 * | 8/2002 | Powers | 248/129 |
| 6,938,730 | B2 | 9/2005 | Hairston | |
| 7,121,518 | B2 * | 10/2006 | Hovde et al. | 248/460 |

* cited by examiner

*Primary Examiner*—Korie Chan

(57) ABSTRACT

A ceiling panel support apparatus includes a base that includes a plurality of legs each with a first end and a second end. The first ends are attached together and the legs radiate outwardly from each other. A support guide is attached to and extends upwardly from the base. A support post is slidably mounted in the guide and is extendable upwardly from a top edge of the support guide. A lifting assembly is mounted on the support post and is mechanically coupled to the support post. The lifting assembly lowers or lifts the support post with respect to the support guide when the lifting assembly is actuated. A plate is attached to an upper end of the support post. A plurality of arms is attached to the plate. The arms extend outwardly from a perimeter edge of the plate. A ceiling panel is positionable on the arms.

10 Claims, 7 Drawing Sheets

CEILING PANEL SUPPORT APPARATUS

BACKGROUND OF THE INVENTION

1. Field of the Invention

The present invention relates to panel supporting devices and more particularly pertains to a new panel supporting device for assisting a person in supporting and lifting a ceiling panel to be installed.

2. Summary of the Invention

The present invention meets the needs presented above by generally comprising a base that includes a plurality of legs each with a first end and a second end. The first ends are attached together and the legs radiate outwardly from each other. A support guide is attached to and extends upwardly from the base. A support post is slidably mounted in the guide and is extendable upwardly from a top edge of the support guide. A lifting assembly is mounted on the support guide and is mechanically coupled to the support post. The lifting assembly lowers or lifts the support post with respect to the support guide when the lifting assembly is actuated. A plate is attached to an upper end of the support post and lies in a plane orientated perpendicular to a longitudinal axis of the support post. A plurality of arms is attached to the plate. The arms extend outwardly from a perimeter edge of the plate. A ceiling panel is positionable on the arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
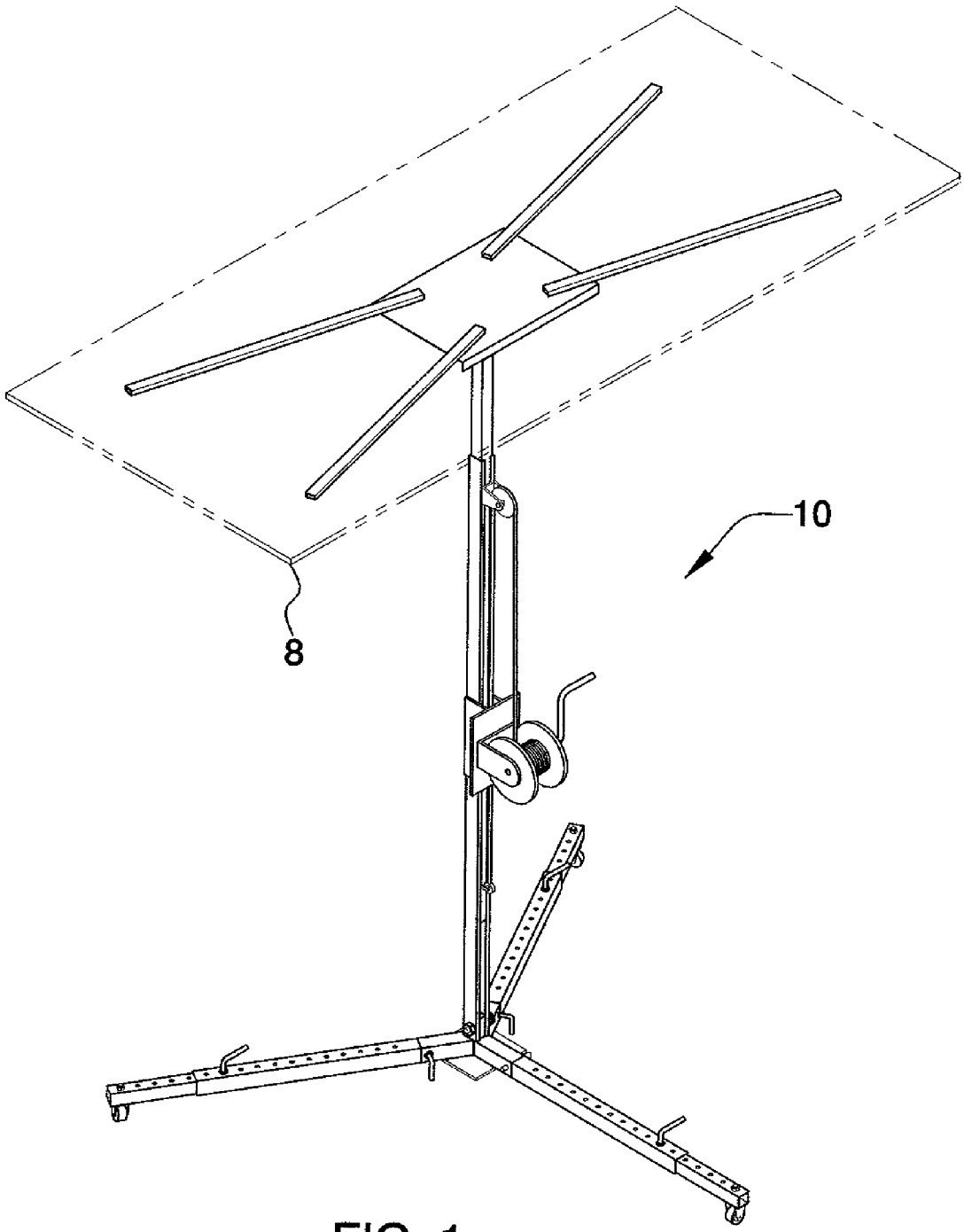
FIG. 1 is a top perspective view of a ceiling panel support apparatus according to the present invention.
Figure 2:
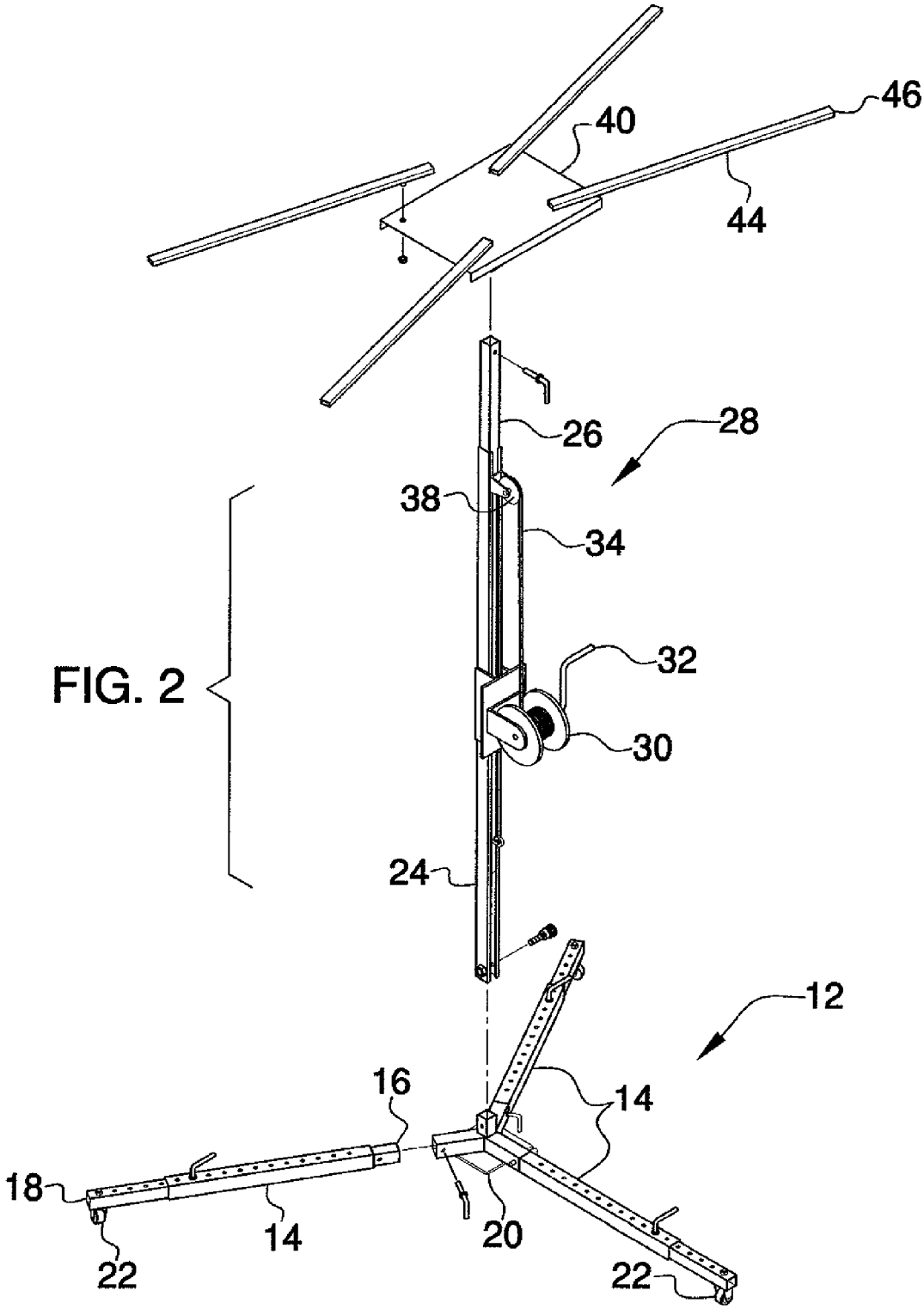
FIG. 2 is a top expanded perspective view of the present invention.
Figure 3:
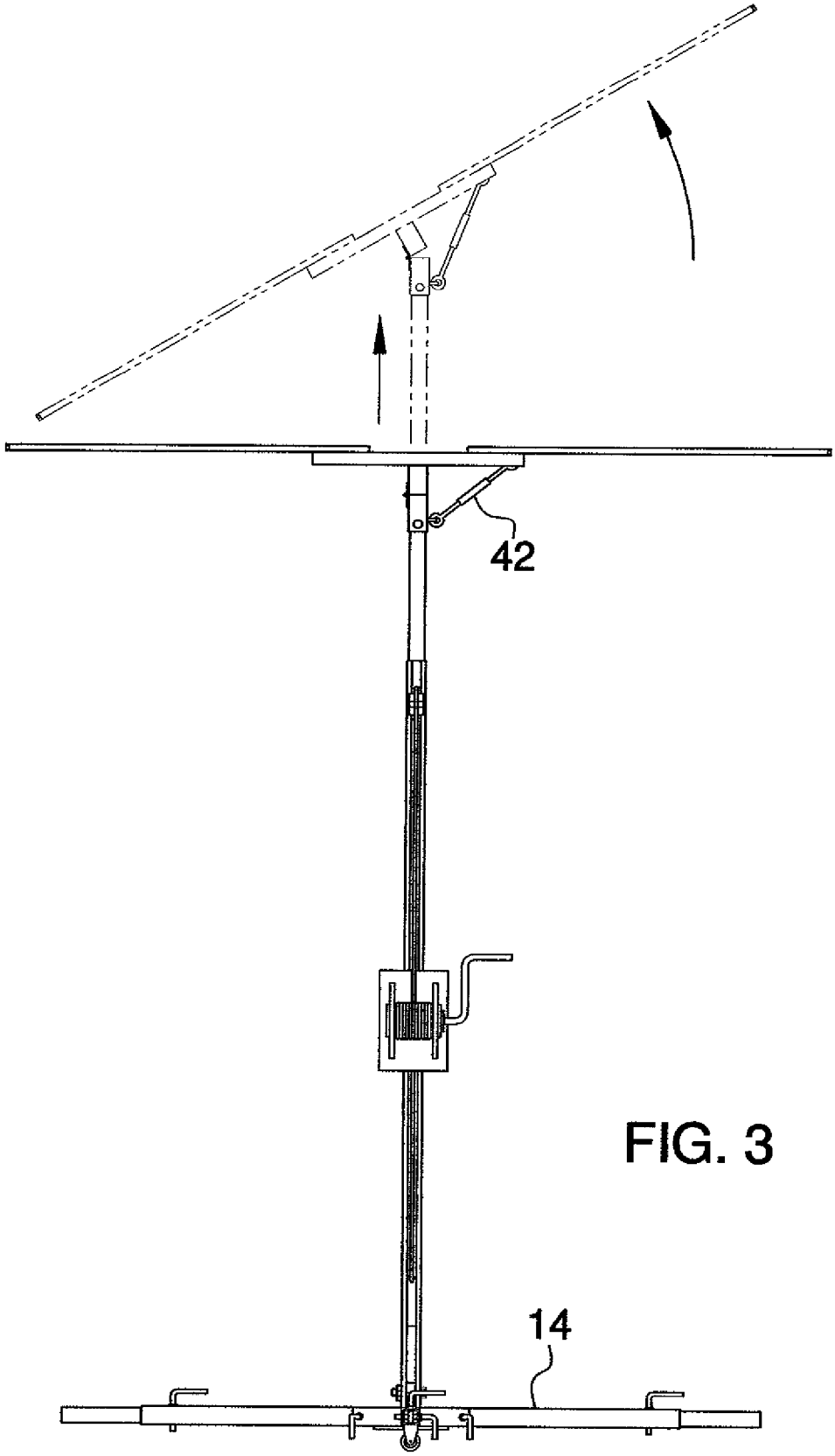
FIG. 3 is a front view of the present invention.
Figure 4:
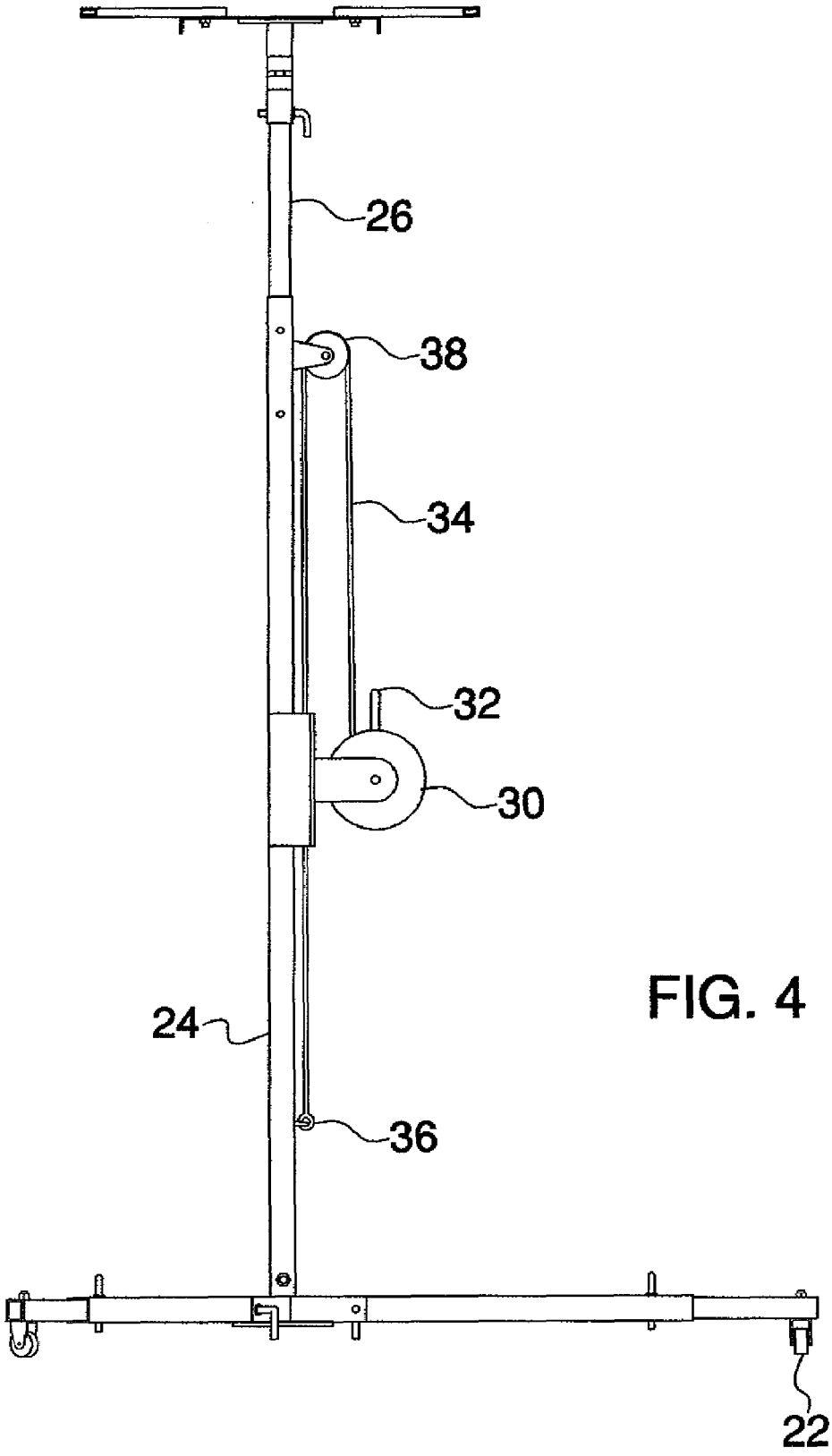
FIG. 4 is a right side view of the present invention.
Figure 5:
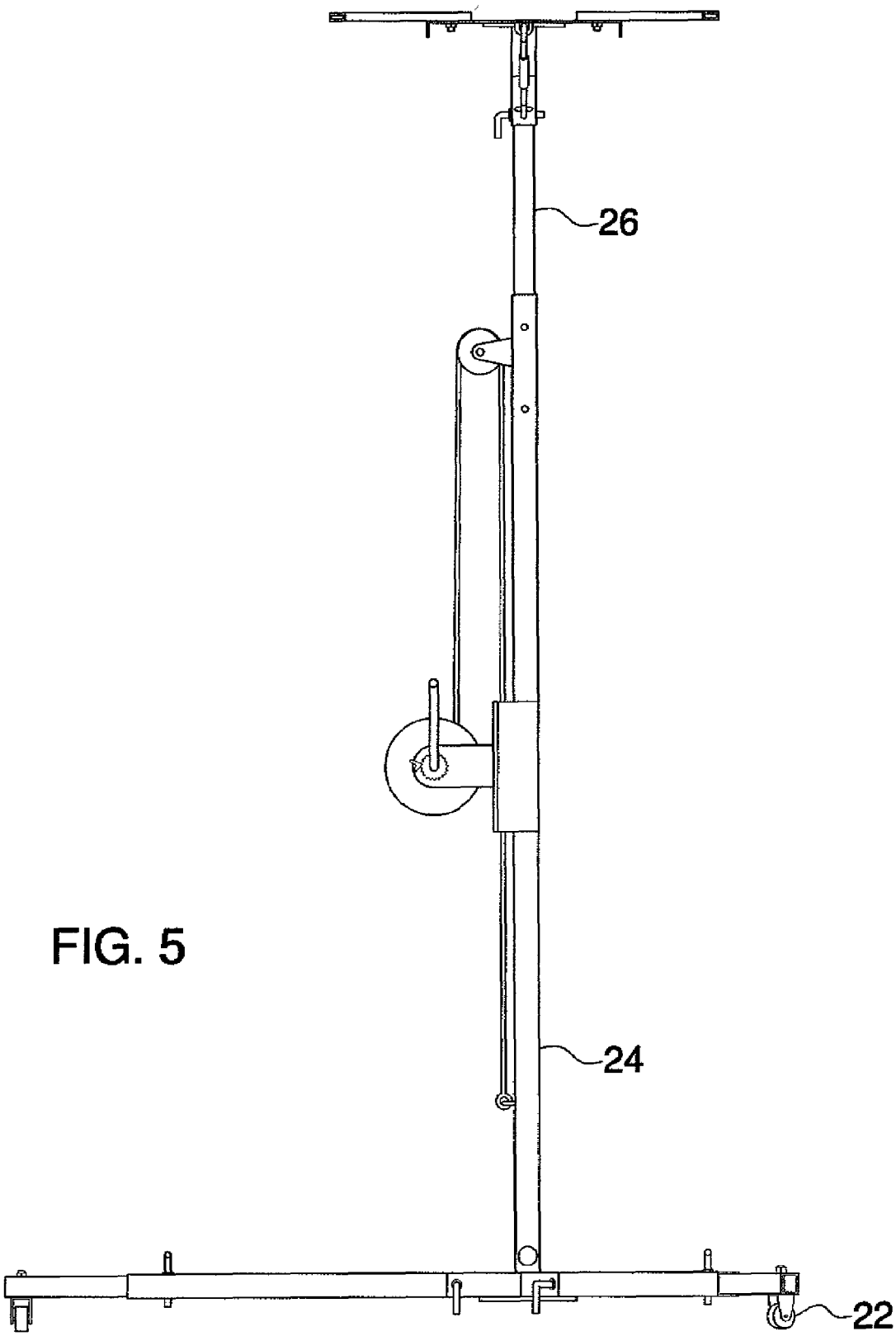
FIG. 5 is a left side view of the present invention.
Figure 6:
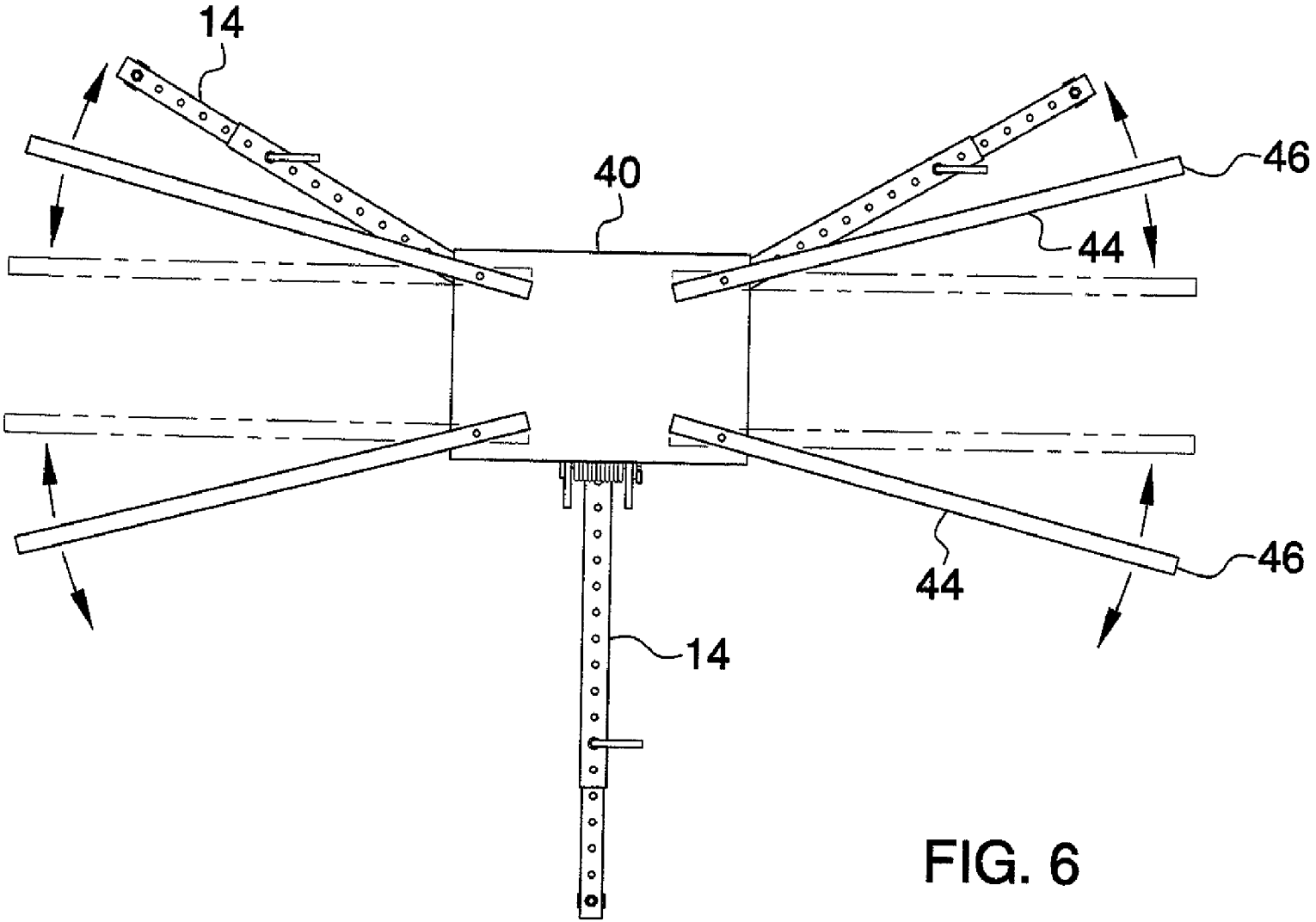
FIG. 6 is a top view of the present invention.
Figure 7:
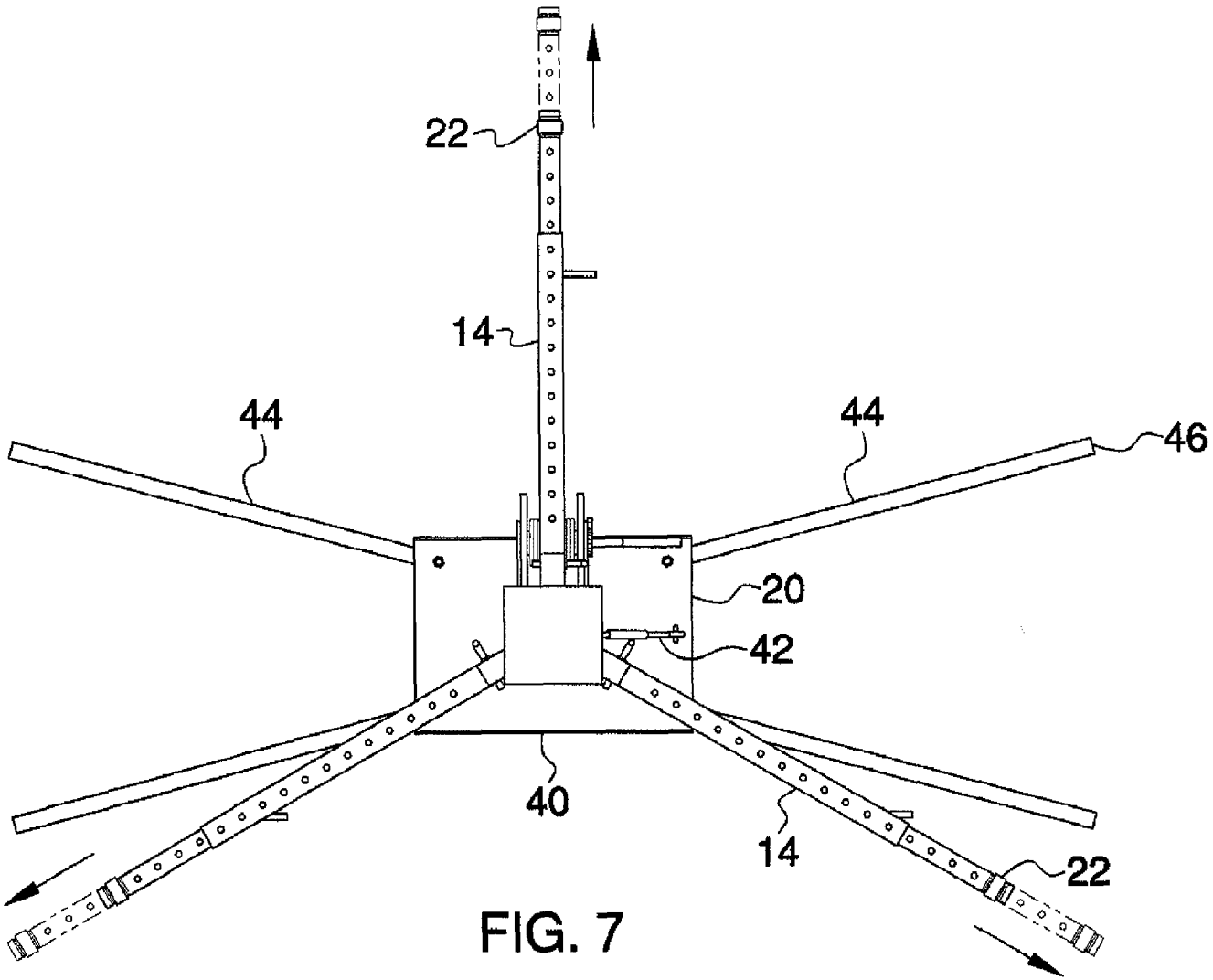
FIG. 7 is a bottom view of the present invention.

With reference now to the drawings, and in particular to FIGS. 1 through 7 thereof, a new panel supporting device embodying the principles and concepts of the present invention and generally designated by the reference numeral 10 will be described.

As best illustrated in FIGS. 1 through 7, the ceiling panel 8 support apparatus 10 generally comprises a base 12 that includes a plurality of legs 14 each having a first end 16 and a second end 18. The first ends 16 are attached together and the legs 14 radiate outwardly from each other. The first ends 16 may be removably attached to a bottom wall 20 of the base 12 and lie in a plane oriented parallel to the bottom wall 20. The legs 14 lie in a horizontal plane and include at least three legs 14. The base 12 further includes a plurality of foot members 22. Each of the legs 14 has one of the foot members 22 attached thereto and positions the legs 14 off of a ground surface. Each of the foot members 22 is positioned adjacent to a respective one of the second ends 18 and comprises a wheel to allow for easy movement of the base 12 along a floor surface. Each of the legs 14 is telescopic and has an adjustable length.

A support guide 24 is attached to and extends upwardly from the base 12 and more particularly is removably attached to the bottom wall 20. A support post 26 is slidably mounted in the guide 24 and is extendable upwardly from a top edge of the support guide 24. The support guide 24 can be extended to a total height of between 8 feet and 14 feet above a floor surface.

A lifting assembly 28 is mounted on the support guide 24 and is mechanically coupled to the support post 26. The lifting assembly 28 lowers or lifts the support post 26 with respect to the support guide 24 when the lifting assembly 28 is actuated. The lifting assembly 28 includes a reel 30 that is rotatably coupled to the support guide 24. A handle 32 is mounted on the reel 30 to facilitate rotation of the reel 30. A tether 34 is wound on the reel 30 and an end 36 of the tether 34 is attached to the support post 26. A pulley 38 is mounted on the support guide 24 and is positioned above the reel 30. The tether 34 is positioned on the pulley 38.

A plate 40 is attached to an upper end of the support post 26. The plate 40 lies in a plane orientated perpendicular to a longitudinal axis of the support post 26 so that the plate 40 is horizontally oriented. The plate 40 is pivotable with respect to the support post 26 to allow the plate 40 to be angled with respect to the support post 26. A plate support 42 retains the plate 40 in an angled orientation. A plurality of arms 44 is attached to the plate 40. The arms 44 extend outwardly from a perimeter edge of the plate 40 and lie in a plane oriented parallel to the plate 40. The arms 44 are pivotable with respect to the plate 40 to selectively position free ends 46 of the arms 44 toward or away from each other. The plurality of arms 44 may include four arms 44. The arms 44 each extend away from the support post 26 a distance of at least 2 feet.

In use, a ceiling panel 8, such as a drywall panel, is positioned on the arms 44. The arms 44 are adjusted as needed to ensure that the panel 8 is stable on the arms 44. The lifting assembly 28 is then used to lift the panel 8 so that it is positioned adjacent to ceiling joists and the panel 8 is then attached to the ceiling joists. The plate 40 is then lowered so that another ceiling panel 8 can be positioned on and lifted by the plate 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling panel support apparatus comprising:

a base including a plurality of legs having a first end and a second end, said first ends being attached together and said legs radiating outwardly from each other, said base further including;

a support guide being attached to and extending upwardly from said base;

a support post being slidably mounted in said guide and being extendable upwardly from a top edge of said support guide;

a lifting assembly being mounted on said support post and being mechanically coupled to said support post, said lifting assembly lowering or lifting said support post with respect to said support guide when said lifting assembly is actuated;

a plate being attached to an upper end of said support post, said plate lying in a plane orientated perpendicular to a longitudinal axis of said support post;

a plurality of arms being attached to said plate, said arms extending outwardly from a perimeter edge of said plate said arms lying in a plane oriented parallel to said plate, said arms being pivotable with respect to said plate to selectively position free ends of said arms toward or away from each other, said arms remaining in said plane orientated parallel to said plate when said arms are pivoted with respect to said plate; and wherein a ceiling panel is positionable on said arms.

2. The apparatus according to claim 1, said base further including a plurality of foot members, each of said legs having one of said foot members attached thereto to position said legs off of a ground surface, each of said foot members comprises a wheel.

3. The apparatus according to claim 1, wherein each of said legs are telescopic and having an adjustable length.

4. The apparatus according to claim 1, wherein said lifting assembly includes:

a reel being rotatably coupled to said support guide, a handle being mounted on said reel to facilitate rotation of said reel;

a tether being wound on said reel, an end of said tether being attached to said support post; and a pulley being mounted on said support guide and being positioned above said reel, said tether being positioned on said pulley.

5. The apparatus according to claim 1, wherein said plurality of arms is four arms.

6. The apparatus according to claim 1, wherein said plate is pivotable with respect to said support post to allow said plate to be angled with respect to said support post.

7. The apparatus according to claim 6, further including a plate support retaining said plate in an angled orientation with respect to said support guide.

8. A ceiling panel support apparatus comprising:

a base including a plurality of legs having a first end and a second end, said first ends being attached together and said legs radiating outwardly from each other, said legs lying in a horizontal plane, said plurality of legs including at least three legs, said base further including a plurality of foot members, each of said legs having one of said foot members attached thereto to position said legs off of a ground surface, each of said foot members being positioned adjacent to a respective one of said second ends, each of said foot members comprising a wheel, each of said legs being telescopic and having an adjustable length;

a support guide being attached to and extending upwardly from said base;

a support post being slidably mounted in said guide and being extendable upwardly from a top edge of said support guide;

a lifting assembly being mounted on said support guide and being mechanically coupled to said support post, said lifting assembly lowering or lifting said support post with respect to said support guide when said lifting assembly is actuated, said lifting assembly including;

a reel being rotatably coupled to said support guide, a handle being mounted on said reel to facilitate rotation of said reel;

a tether being wound on said reel, an end of said tether being attached to said support post;

a pulley being mounted on said support guide and being positioned above said reel, said tether being positioned on said pulley;

a plate being attached to an upper end of said support post, said plate lying in a plane orientated perpendicular to a longitudinal axis of said support post;

a plurality of arms being attached to said plate, said arms extending outwardly from a perimeter edge of said plate, said arms lying in a plane oriented parallel to said plate, said arms being pivotable with respect to said plate to selectively position free ends of said arms toward or away from each other, said plurality of arms being four arms, said arms remaining in said plane orientated parallel to said plate when said arms are pivoted with respect to said plate; and wherein a ceiling panel is positionable on said arms.

9. The apparatus according to claim 8, wherein said plate is pivotable with respect to said support post to allow said plate to be angled with respect to said support post.

10. The apparatus according to claim 9, further including a plate support retaining said plate in an angled orientation with respect to said support guide.

* * * * *